US006644660B2

(12) United States Patent
Sussmeier et al.

(10) Patent No.: US 6,644,660 B2
(45) Date of Patent: Nov. 11, 2003

(54) DYNAMIC PITCH CORRECTION FOR AN OUTPUT INSERTER SUBSYSTEM

(75) Inventors: John W. Sussmeier, Cold Spring, NY (US); Jerry Leitz, New Milford, CT (US); Arthur H. Depoi, Brookfield, CT (US); Gregory P. Skinger, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 67 days.

(21) Appl. No.: 10/040,207

(22) Filed: Oct. 26, 2001

(65) Prior Publication Data

US 2003/0083779 A1 May 1, 2003

(51) Int. Cl.[7] ..... B65H 5/34

(52) U.S. Cl. ..... 271/270; 271/258.01; 271/265.01; 271/265.02

(58) Field of Search ..... 271/270, 272, 271/264, 258.9, 259, 265.01, 265.02

(56) References Cited

U.S. PATENT DOCUMENTS 3,683,757 A * 8/1972 Lenk ..... 493/17
4,451,027 A * 5/1984 Alper ..... 271/10.02
5,423,527 A * 6/1995 Tranquilla ..... 271/10.02
5,813,668 A * 9/1998 Lund ..... 271/2
5,848,784 A 12/1998 Tranquilla ..... 271/10.03
6,023,034 A * 2/2000 Nakajima et al. ..... 209/584

* cited by examiner

*Primary Examiner*—Donald P. Walsh
*Assistant Examiner*—Kaitlin Joerger
(74) *Attorney, Agent, or Firm*—Michael J. Cummings; Charles R. Malandra, Jr.; Angelo N. Chaclas

(57) ABSTRACT

A system and method for correcting the timing and spacing between envelopes being serially processed in a high speed mail processing inserter system, whereby a pitch correcting module receives sensor input detecting unwanted pitch variation between envelopes and a transport mechanism in the pitch correcting module accelerates or decelerates an envelope according to a pitch correcting profile calculation performed by the pitch correcting module, the pitch correcting module being dimensioned to optimally perform pitch correction without interfering with high speed mail processing.

20 Claims, 3 Drawing Sheets

DYNAMIC PITCH CORRECTION FOR AN OUTPUT INSERTER SUBSYSTEM

TECHNICAL FIELD

The present invention relates to a module correcting pitch between documents traveling in a high speed mass mail processing and inserting system. The term "pitch" refers to the spacing between documents traveling in an inserter system. Properly controlled and predictable document pitch is necessary for reliable operation of such high speed inserter systems.

BACKGROUND OF THE INVENTION

Inserter systems such as those applicable for use with the present invention, are typically used by organizations such as banks, insurance companies and utility companies for producing a large volume of specific mailings where the contents of each mail item are directed to a particular addressee. Additional, other organizations, such as direct mailers, use inserts for producing a large volume of generic mailings where the contents of each mail item are substantially identical for each addressee. Examples of such inserter systems are the 8 series and 9 series inserter systems available from Pitney Bowes Inc. of Stamford Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

An inserter system may typically include a right angle transfer module to perform a 90-degree change of direction of documents flowing through the inserter system. The right angle transfer module allows for different configurations of modules in an inserter system and provides flexibility in designing a system footprint to fit a floor plan. Such a right angle transfer module is typically located after the envelope-stuffing module, and before the final output modules. Right angle transfer modules are well known in the art, and may take many different forms.

During processing, envelopes will preferably remain a regulated distance (or "pitch") from each other as they a transported through the system. Also, envelopes typically lie horizontally, with their edges perpendicular and parallel to the transport path, and have a uniform position relative to the sides of the transport path during processing. Predictable envelope positioning helps the processing modules perform their respective functions. For example, if an envelope enters a postage-printing module crooked, it is less likely that a proper postage mark will be printed. For these reasons it is important to ensure that envelopes do not lie askew on the transport path, or at varying distances from the sides of the transport path.

For this purpose, envelopes, or other documents, are typically urged against an aligning wall along the transport path so that an edge of the envelope will register against the aligning wall thereby straightening the envelope and puffing it at a uniform position relative to the sides of the transport path. This aligning function may be incorporated into a right angle transfer module, whereby a document may impact against an aligning wall as part of performing a 90-degree change of direction.

Typically the envelope edge that is urged against the aligning wall is the bottom edge, opposite from the top flapped edge of the envelope. Thus after coming into contact with the aligning wall and being "squared up," the envelope travels along the transport path with the left or right edge of the envelope as the leading edge.

The action of impacting the bottom edge of the envelope against the aligning wall may also serve the purpose of settling the stuffed collation of documents towards the bottom of the envelope. By settling the collation to the bottom of the envelope it is more likely that no documents will protrude above the top edge of the envelope, and that the envelope flap can be closed and sealed successfully.

Current mail processing machines are often required to process up to 18,000 pieces of mail an hour. Such a high processing speed may require envelopes in an output subsystem to have a velocity as fast as 85 inches per second (ips) for processing. Envelopes will nominally be spaced 200 ms apart for proper processing while traveling through the inserter output subsystem. At such a high rate of speed, system modules, such as those for sealing envelopes and putting postage on envelopes, have very little time in which to perform their functions. If spacing is not maintained between envelopes, the modules may not have time to perform their functions, envelopes may overlap, and jams and other errors may occur.

For example, if the space between contiguous envelopes has been shortened, a subsequent envelope may arrive at the postage metering device before the meter has had time to reset, or perhaps even before the previous envelope has left. As a result, the meter will not be able to perform its function on the subsequent envelope before a subsequent envelope arrives, and the whole system may be forced to a halt. At such high speeds there is very little tolerance for variation in the spacing between envelopes.

Other potential problems resulting from excess variation in distance between envelopes include decreased reliability in diverting mechanisms used to divert misprocessed mail pieces, and decreased reliability in the output stacking device. Each of these devices have a minimum allowable distance between envelopes that may not be met when unwanted variation occurs while envelopes travel at 85 ips.

Jam detection within the aligning module may become difficult to manage as a result of excess pitch variation. Jam detection is based on theoretical envelope arrival and departure times detected by tracking sensors along the envelope path. Variability in the aligner module will force the introduction of wide margins of error in the tracking algorithm, particularly for start and stop transport conditions, making jam detection less reliable for that module.

Pitch variation occurs for a number of reasons. One source of variation can be an aligner module for a high-speed inserter system, as described above. As envelopes in a high speed mailing system impact the conventional aligner wall, the impact causes the envelopes to decelerate in a manner that may cause the gap between envelopes to vary as much as +/−30 ms. While such a variation might not be significant in slower machines, this variation can be too much for the close tolerances in current high speed inserter machines.

In addition to variation resulting from impacts at the aligner module, variation may be the result of "dither" in the transport of stuffed envelopes. Different envelopes may be stuffed with different quantities of sheets that form the individual mail pieces. As a result, envelopes will vary in weight. Such variation in weight will cause envelopes to have different acceleration, momentum and frictional forces acting upon them as they are transported in the inserter output subsystem. For example, different envelopes will experience different slippage as transport mechanisms such as rollers and belts are used to transport them. Accordingly, such dither may result in an additional +/−30 ms variation in the spacing between envelopes.

The problem of non-deterministic behavior at the aligning module is addressed in a co-pending patent application entitled DETERMINISTIC ALIGNER FOR AN OUTPUT INSERTER SYSTEM, by John Sussmeier, filed on Oct. 18, 2001, Ser. No 09/981,959 and commonly assigned to the assignee of the present application. That application is hereby incorporated by reference in its entirety. The aligner system described in that application may be used in conjunction with the system described in the present application in order to minimize variation in spacing between envelopes traveling in an inserter output subsystem.

The present application describes a system and a method to reduce variation in envelope pitch to further meet the needs and shortcomings of the conventional art described above.

SUMMARY OF THE INVENTION

The present invention addresses the problems of the conventional art by providing a pitch correcting module ("PCM"). The pitch correcting module is positioned upstream of modules that are sensitive to variation in pitch, in order that such variations may be corrected before the envelopes reach those modules. The pitch correction module includes a transport mechanism, such as hard nip rollers, or conveyor belts, to speed up or slow down the transport of envelopes in order to correct pitch variations. The relative spacing of envelopes is preferably detected by sensors which sense envelopes entering and leaving the pitch correcting module. Based on input from the sensors, a processing device controls the transport mechanism of the PCM to speed up or slow down the envelope in accordance with a predetermined algorithm.

The pitch correcting module is dimensioned to accommodate the varying envelopes sizes that the inserter system is designed to process, while at the same time maintaining the capability of the inserter system to operate at its designed speed, and to correct the range of expected unwanted variation. The PCM is also designed to provide the necessary accelerations and decelerations to achieve corrections within a range of expected pitch variations.

DETAILED DESCRIPTION

Figure 1:
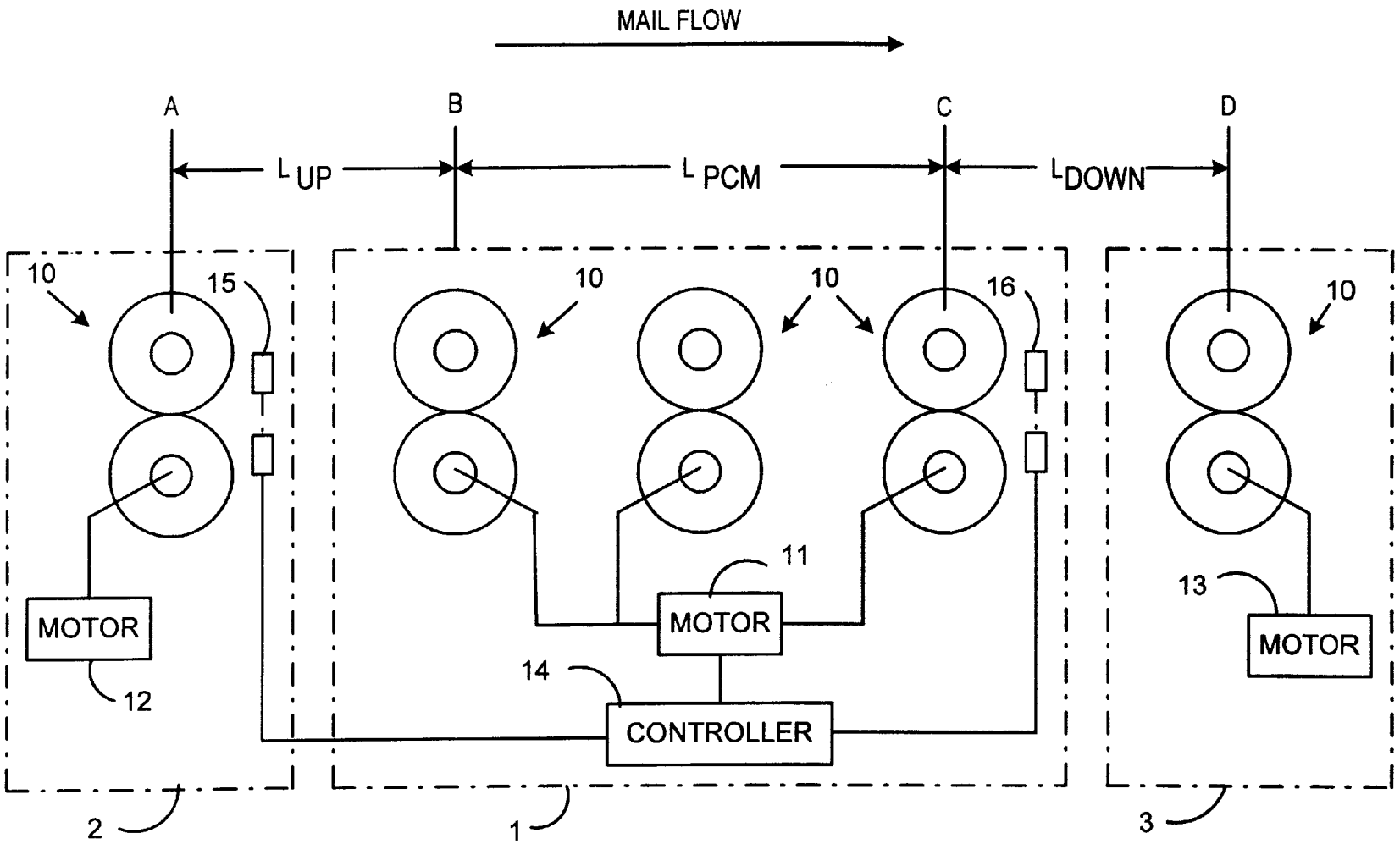
FIG. 1 is a diagrammatic view of a pitch correcting module in relation to upstream and downstream modules.

As seen in FIG. 1, the present invention includes a pitch correcting module (PCM) 1 positioned between an upstream module 2 and a downstream module 3. An example of upstream module 2 could be a right angle transfer, or an aligner module such as that described in the aforementioned co-pending U.S. patent application Ser. No. 09/981,959 of Sussmeier, incorporated in its entirety. An exemplary downstream module 3 could be a diverting module, a metering module, or a stacking module, each of which includes a sensitivity to pitch variation. Besides these examples, upstream and downstream modules 2 and 3 can be any kinds of modules in an inserter output subsystem.

PCM 1, upstream module 2, and downstream module 3, all include transport mechanisms for moving envelopes along the processing flow path. In the depicted embodiment, the modules use sets of upper and lower rollers 10, called nips, between which envelopes are driven in the flow direction. In the preferred embodiment rollers 10 are hard-nip rollers to minimize dither. As an alternative to rollers 10, the transport mechanism may comprise overlapping sets of conveyor belts between which envelopes are transported.

The rollers 10 for PCM 1, and modules 2 and 3 are driven by electric motors 11, 12, and 13 respectively. Motors 11, 12, and 13 are preferably independently controllable servo motors. Motors 12 and 13 for upstream and downstream modules 2 and 3 drive their respective rollers 10 at a constant velocity, preferably at the desired nominal velocity for envelopes traveling in the system. Accordingly, upstream and downstream modules 2 and 3 will transport envelopes at 85 ips in the flow direction.

Motor 11 drives rollers 10 in the PCM 1 at varying speeds in order to provide pitch correction capabilities. When no pitch correction is required PCM 1 will transport envelopes at the same velocity as the upstream and downstream modules 2 and 3. PCM motor 11 is controlled by controller 14 which in turn receives sensor signals including signals from upstream sensor 15 and downstream sensor 16. Sensors 15 and 16 are preferably used to detect the trailing edges of consecutive envelopes passing through the PCM 1. By receiving sensor signals indicating the trailing edges of envelopes, controller 14 can calculate the pitch between consecutive envelopes and adjust the speed of PCM motor 11 to correct variance from a nominal desired pitch.

While a single sensor could be used to detect the pitch between consecutive envelopes, the preferred embodiment of the present invention utilizes at least two sensors 15 and 16, one positioned near each of the boundaries between PCM 1 and the upstream and downstream modules 2 and 3. Such sensors are preferably photo sensors that detect the trail edge of envelopes. By comparing sensor signals corresponding to consecutive envelopes, actual pitch between envelopes is calculated in terms of time and/or displacement. The preferred positioning of the sensors, and the utilization of signals received from the sensors is discussed in more detail below.

One aspect of the present invention relates to the relative positioning of the transport mechanisms between PCM 1 and the other modules. Referring to FIG. 1, the location of the output of the transport for upstream module 2 is location A. The location for the input to the transport of PCM 1 is location B, and the output of the transport mechanism for PCM 1 is location C. The input for the transport of downstream module 3 is location D.

In the exemplary embodiment shown in FIG. 1, the transport mechanisms are nip rollers 10 for each of the modules. Accordingly locations A, B, C, and D correspond to the respective locations of input and output nip rollers 10 in that embodiment. The modules may also include other rollers 10 at other locations, such as the set depicted in FIG. 1 between locations B and C, also driven by motors 11, 12, and 13 for the respective modules. In the example depicted in FIG. 1, the three nip rollers sets 10 in PCM 1 will be driven by motor 11. To maintain control over envelopes traveling through the system, consecutive distances between rollers 10 must be less than the shortest length envelope expected to be conveyed. In the preferred embodiment, it is expected that envelopes with a minimum length of 6.5" will be conveyed. Accordingly and the rollers 10 will preferably be spaced 6.25" apart, so that an envelope can be handed off between sets of rollers 10 without giving up control transporting the envelope at any time.

Upstream sensor 15 is preferably located at or near location A, while downstream sensor 16 is preferably located at or near location C. As mentioned above, pitch computation could be accomplished using one sensor, however in the preferred embodiment pitch correction is calculated after a downstream envelope has received its pitch correction via PCM 1, and has exited PCM 1 from the nip rollers 10 at location C. In that way, PCM can perform corrections on envelopes one-at-a-time and perform pitch correction operations separately for consecutive envelopes. This arrangement simplifies the calculations to be done by controller 14 in adjusting the speed of PCM 1 to make the appropriate corrections between consecutive envelopes.

Downstream sensor 16 detects the departure of an envelope from PCM 1 as it exits the rollers 10 at location C. Subsequently, upstream sensor 15 detects the arrival of a new envelope for which control is being transferred from the upstream module 2 to PCM 1. Controller 14 receives the sensor information and, based on the desired nominal speed and spacing of the envelopes, determines a variation in the measured pitch from the nominal expected pitch.

Envelopes that arrive later than the desired pitch are accelerated by PCM 1 and then decelerated back to the constant velocity of the downstream module 3 before the lead edge of the envelope reaches location D. This motion has the effect of advancing the envelope closer to the previous downstream envelope.

Conversely, envelopes that arrive earlier than the desired pitch are decelerated by PCM 1 and then accelerated back to the constant velocity of the downstream module 3 before the lead edge of the envelope reaches location D. This motion has the effect of retarding the envelope relative to the previous downstream envelope.

The necessary advancing and retarding action of PCM 1 is controlled according to a motion profile calculated by controller 14. Motion profiles are individually calculated for each envelope as a function of the pitch information collected by sensors 15 and 16.

Figure 2:
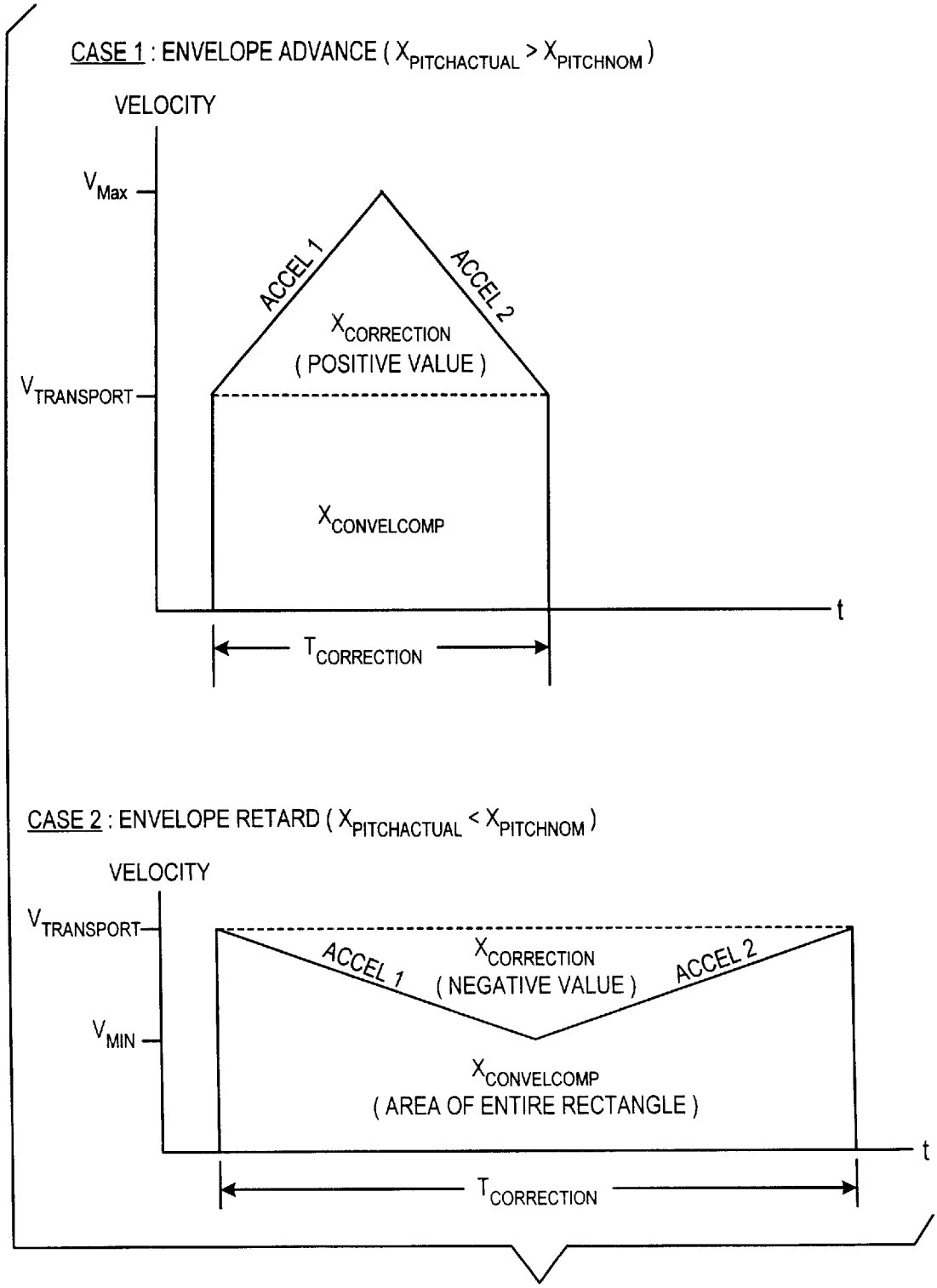
FIG. 2 is a graphical representation for velocity profiles for performing dynamic pitch correction on envelopes.

Referring to FIG. 2, exemplary motion profiles are illustrated for both an envelope advance profile and an envelope retard profile. This figure depicts graphs showing the velocity of the envelope as a function of time while passing through PCM 1. Acceleration of the envelope is represented by the slope of the lines. $V_{transport}$ represents the nominal velocity of the transports in the system, preferably 85 ips. $T_{correction}$ represents the time during which pitch correction is executed by PCM 1. The area under the velocity curve during $T_{correction}$ represents the displacement of the envelope during pitch correction.

In FIG. 2, the area represented by the rectangle below $V_{transport}$ represents the displacement of the envelope ($X_{nominal}$) as if it were traveling at nominal speed. However, this displacement must be increased or decreased in order to perform pitch correction. Accordingly, in FIG. 2, $X_{correction}$ represents the area of the increased or decreased displacement above or below the $X_{nominal}$ value resulting from the corresponding acceleration and deceleration.

The retard profile is illustrated in FIG. 2 using accelerations that are less than that of the advance profile to illustrate a correction that is allowed to occur over a longer pitch correction time, $T_{correction}$.

It should be noted that although FIG. 2 depicts pitch correction motion profiles having constant acceleration and deceleration values of equal magnitudes, it is not necessary that a motion profile have those characteristics. Rather, the motion profile may take any form, so long as it achieves the required displacement correction within the limited time and space available.

The preferred embodiment of the present invention, however, does use constant acceleration and deceleration in the manner depicted in FIG. 2. Accordingly, in the preferred embodiment an envelope undergoing pitch correction will undergo acceleration and deceleration of equal magnitudes for half of the envelope travel distance within PCM 1. Using the motion profile with linear segments, the calculation for determining accelerations for achieving displacements can be calculated easily by calculating the slope of the lines representing velocity necessary to achieve the desired displacement. If non-linear acceleration is used, the appropriate calculations can be more complicated, but may be achieved using known integration algorithms.

The pitch correcting profiles as depicted in FIG. 2 are designed to begin when the tail end of the envelope to be pitch corrected exits the upstream module 2 at location A and to end when the lead edge of the envelope reaches the downstream modules 3 at location D. This methodology minimizes the accelerations and deceleration required during the pitch correction profile, thereby minimizing the heating of PCM motor 11.

When performing pitch correction on an envelope, PCM 1 must have total control of the envelope. For example, the envelope cannot reside between nip rollers 10 at location A or D during execution of the pitch correcting profile. Additionally, in the preferred embodiment, envelopes upstream and downstream of the envelope being pitch corrected must be completely out of PCM 1, i.e., they cannot reside anywhere between nip rollers 10 between locations B and C during the execution of the pitch correcting profile. Accordingly, in the preferred embodiment, PCM 1 will only perform the pitch correcting profile (1) after the trail edge of the envelope to be pitch corrected has exited upstream module 2 at location A; and (2) after the trail edge of the downstream envelope has exited PCM 1. Similarly, in the preferred embodiment, PCM 1 must complete the pitch correcting profile (1) before the lead edge of the upstream envelope has reached PCM at location B; and (2) before the lead edge of the envelope to be pitch corrected has reached the downstream module 3 at location D.

In practice, these requirements will limit the range of lengths for PCM 1 in order that it can process envelopes of the desired sizes at the desired speed. The pitch correcting system must be able to process minimum and maximum specified envelope lengths and correct the pitch in the anticipated worst case error condition.

Figure 3:
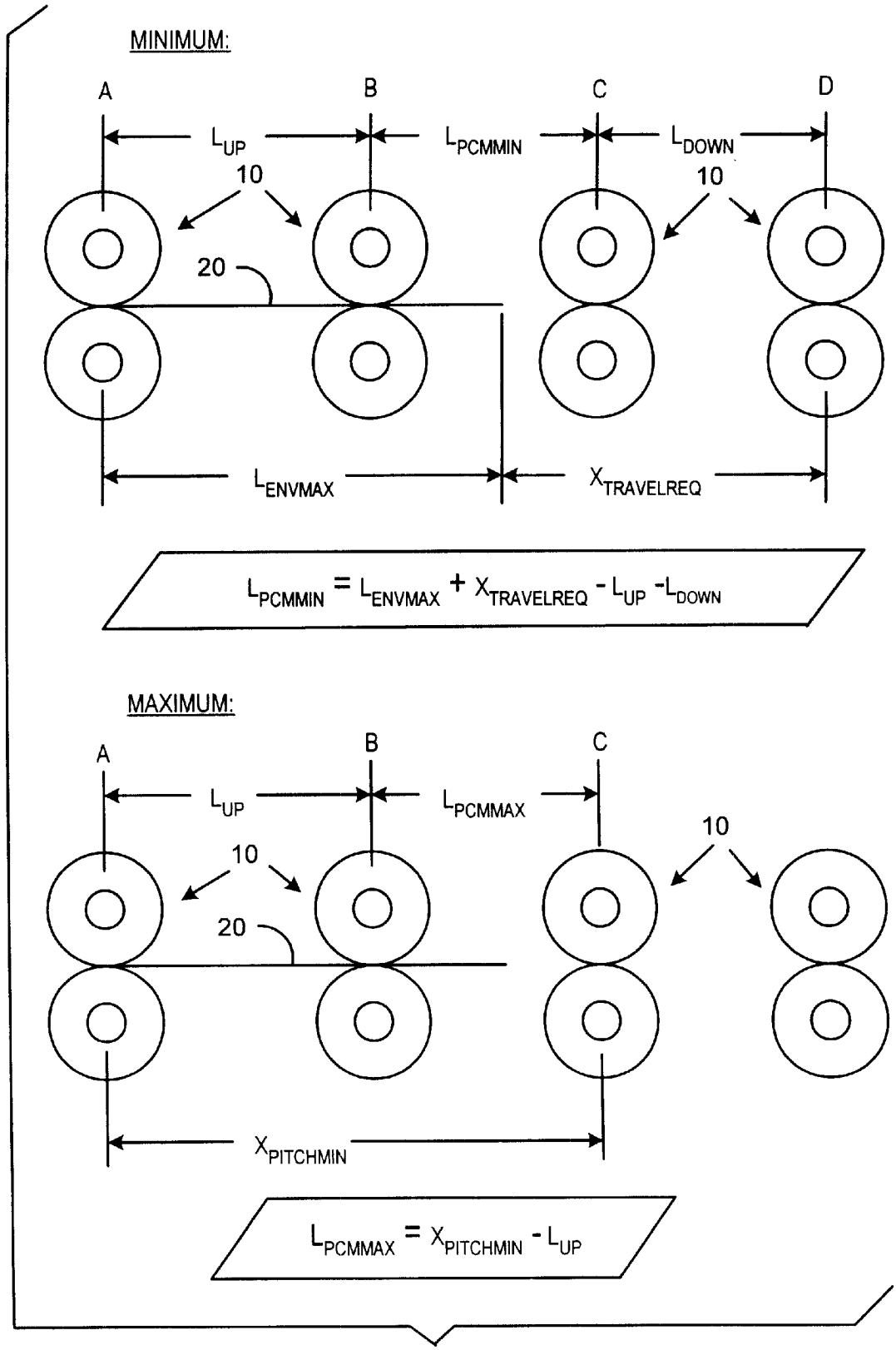
FIG. 3 is a diagrammatic view of spacing of key input and output locations for the pitch correcting module.

FIG. 3 depicts relative locations of elements in the pitch correcting system for determining an appropriate size for PCM 1 to achieve the desired functionality. As discussed previously, the nip rollers 10 at locations B and C are the input and output to the transport mechanism for PCM 1. The nip rollers 10 at locations A and D are the output from the upstream module 2 and the input to the downstream module 3, respectively. FIG. 3 further depicts a maximum size envelope 20 as it comes under full control of PCM 1.

In the preferred embodiment, the minimum and maximum expected envelope lengths are 6.5 and 10.375 inches respectively. As discussed above, in order to always maintain control of the smallest envelope, the distance between location A and B ($L_{up}$) and the distance between location C and location D ($L_{down}$) will be 6.25" in the preferred embodiment of the present invention. Additionally the analysis for determining the length of PCM 1 in the preferred embodiment assumes that the maximum anticipated correction is 30 ms, that the minimum desired period between envelopes is 200 ms, and that the velocity of the transports in upstream and downstream modules 2 and 3 is 85 ips.

To determine the minimum length of PCM 1 ($L_{pcmmin}$ in FIG. 3), PCM 1 must be able to complete the longest pitch correction profile to advance the envelope if it requires the largest anticipated correction. This calculation takes into account the longest envelope, because the longer the envelope, the shorter the available space within the PCM to perform the correction. The determination of $L_{pcmmin}$ also depends on the maximum allowable acceleration based on the maximum torque characteristics of PCM motor 11 and the frictional characteristics of rollers 10 in PCM 1.

Based on the arrangement depicted in FIG. 3, the equation for determining minimum length for PCM 1 is:

$$L_{pcmmin}=L_{envmax}+X_{travelreq}-L_{up}-L_{down}$$

$X_{travelreq}$ is the total required distance traveled during the longest pitch correction profile as a function of the maximum allowable acceleration. Since the maximum expected correction is 30 ms at 85 ips, the necessary correction will require the envelope to be advanced an additional 2.55 inches over the nominal displacement while traveling in PCM 1. Assuming a maximum acceleration of 8 G's, based on typical conservative limits for DC brushless motor systems, $X_{travelreq}$ can be calculated by referring to the motion profile as shown in FIG. 2, and calculating the total distance to be traveled within PCM 1. This calculation results in $X_{travelreq}$ being 7.433 inches. Inserting the other values given above into the above equation for $L_{pcmmin}$, the minimum length for PCM 1 is calculated to be 5.308 inches under the preferred conditions described herein.

Although a maximum acceleration of 8G's has been selected for the preferred embodiment, this maximum may be increased or decreased based on the needs of the system. For example, if it is required that PCM 1 be capable of correcting variations greater than +/−30 ms, then a more robust, and more costly, electric motor may be used to achieve that greater acceleration. Conversely, if PCM 1 is to be used in a system that is intended to only correct lesser variations, a less robust, and potentially less expensive, electric motor may be used. It should be noted, however, that the acceleration characteristics of PCM motor 11 impact the minimum size of PCM 1.

Again referring to FIG. 3, the maximum length of PCM 1, ($L_{pcmmax}$ on FIG. 3), is determined by calculating the maximum length of PCM 1 before the tail end of an upstream envelope will exit the upstream module 2 at location A before the tail end of the downstream envelope exits PCM 1 at location C. Expressed as an equation:

$$L_{pcmmax}=X_{pitchmin}-L_{up},$$

where $X_{pitchmin}$ is the minimum expected distance between envelopes resulting from unwanted variation.

Substituting in the quantities for the preferred embodiments given above, the value of $L_{pcmmax}$ is 8.200 inches. It should be noted that this calculation does not depend on the size of the envelope, but rather the expected minimum pitch between consecutive envelopes.

Controller 14 of PCM 1 is programmed to determine an appropriate pitch correcting profile, as shown, for example, in FIG. 2, for pitch variations detected by sensors 15 and 16. Based on the calculated pitch correcting profile rollers 10 of PCM 1 are controlled to accelerate and decelerate accordingly in order to achieve the desired displacement correction.

In the preferred embodiment controller 14 calculates the pitch correcting profile based on the physical constants of PCM 1 and the detected pitch variation. The algorithm for the preferred embodiment assumes that upstream and downstream sensors 15 and 16 are located at or near locations A and C respectively. If the upstream sensor is located upstream of location A, the pitch correcting profile begins when the tail end of the envelope reaches location A. If the upstream sensor 15 is located downstream of location A, then the pitch correcting profile begins when the tail end of the envelope reaches upstream sensor 15.

The following are fixed physical variables for all pitch correcting profile calculations:

$L_{pcm}$=distance from the transport mechanism input to the transport mechanism output in PCM 1;

$L_{up}$=separation distance between the output of the upstream module 2 transport to the input of PCM 1; preferred value=6.25";

L1=distance upstream sensor 15 is located downstream of location A (negative value if located upstream of A);

L2=distance downstream sensor 16 is located of location C (negative value if located upstream of C);

For L1>0; $L_{upmod}=L_{up}-L1$ (and pitch correcting profile begins when the tail end of the envelope reaches the upstream sensor 15; otherwise $L_{upmod}=L_{up}$ (and pitch correcting profile begins when the tail end of the envelope reaches location A).

The following are fixed physical variables and calculations for a job run, and their preferred values, are:

$T_{desiredperiod}$=desired period between envelope leading edges; preferred value=200 ms;

$T_{dithermax}$=maximum anticipated time between envelopes under normal conditions expected at PCM 1; preferred value=230 ms;

$T_{dithermin}$=minimum anticipated envelope between envelopes under normal conditions expected at PCM 1; preferred value=170 ms;

$V_{transport}$=nominally constant velocity of upstream and downstream modules 2 and 3; preferred value=85 ips;

$L_{sensors}=L_{up}+L_{pcm}+L2-L1$;

$X_{pitchnom}=V_{transport}*T_{desiredperiod}$ $X_{pitchmax}=V_{transport}*(T_{desiredperiod}-T_{dithermax})$ $X_{pitchmin}=V_{transport}*(T_{desiredperiod}-T_{dithermin})$ $X_{travel}=L_{upmod}+L_{pcm}+L_{down}-L_{env}$ Input variable that changes for every envelope processed:

X=distance the upstream module motor 12 translated from the instant the tail end of downstream envelope reached the downstream sensor 16 to the instant the upstream envelope tail end reached upstream detector 15.

Calculation for determining the actual pitch between envelopes:

$X_{pitchactual}=L_{sensors}+X$

Finally, the following calculations provide the preferred embodiment for determining the accelerations to perform a pitch correcting motion profile of the type as shown in FIG. 2.

If $X_{pitchactual} \geqq X_{pitchmax}$, then Accel1=maximum acceleration, and Accel2=−Accel1; or If $X_{pitchactual} \leqq X_{pitchmin}$, then Accel1=maximum deceleration, and Accel2=−Accel1; otherwise $$Accel1 = \frac{(X_{pitchactual} - X_{pitchnom})}{((X_{travel} - X_{pitchactual} + X_{pitchnom})/(2 * V_{transport}))\wedge 2}; \text{ and}$$

Accel2=−Accel1; and $X1=X2=X_{travel}/2$

As shown in FIG. 2, Accel1 and Accel2 are the accelerations used for each of the two segments of the pitch correcting profile and X1 and X2 are the corresponding total distances traveled during each acceleration segment.

It should be noted that although the above described embodiment preferably calculates displacement, a time based methodology can be substituted. A displacement based methodology is preferred because distance relationships between envelopes and modules can be preserved, even during start-up and stopping conditions.

The above algorithm for correcting pitch assumes that distances between consecutive envelopes is being measured. However, during a start up of a new series of envelopes, there will be no prior envelope. Under those circumstances, the controller 14 is programmed to recognize the first envelope of a series of envelopes in a job run. Similarly, if an envelope is diverted upstream of PCM 1, a larger than expected gap may be encountered before a subsequent envelope arrives. Accordingly, in the preferred embodiment, any envelope that arrives at PCM 1 one or more cycles late will be defined as a first envelope. As a result of the preferred sensor arrangement described above, controller 14 will not be able to tell whether the first envelope has been subject to unwanted variation.

In the preferred embodiment, controller 14 is programmed to always treat a "first envelope" as if it has arrived late by the maximum expected time variation. As a result of this assumption, the first envelope will always be given a forward correction displacement by PCM 1. If this assumption was not made, and the envelope was in fact late, then the second envelope might be too close behind to be properly corrected. Because there is no envelope in front of the first envelope, there is no danger that unnecessarily advancing the first envelope will cause it to come too close to an envelope in front of it.

In an alternative embodiment, instead of assuming that the first envelope is late, the first envelope of a series of envelopes could be tracked as it travels through the inserter output subsystem. The system can be programmed to sense when the first envelope enters the inserter output subsystem, and to record a position or time stamp. Nominal arrival times (or displacements) can be established for the arrival of the first envelope at various downstream locations. Sensors detect the arrival of the envelope at the various locations and it is can be determined whether, in fact, the first envelope is traveling more slowly than nominally desired. If the first envelope is not late to PCM 1, then no advancing displacement acceleration need be applied. This method has the advantage of potentially decreasing motor heating of PCM motor 11 by not requiring it to accelerate unnecessarily. A potential disadvantage to this method is that different style envelopes are not likely to all have the same nominal travel times.

The present invention may also be utilized to correct variations larger than can be handled by a single PCM. If pitch corrections to be performed are too large for a single PCM 1 to correct, then additional PCM modules can be serially arranged to provide cascading pitch correcting profiles.

In another alternative embodiment, rollers 10 at location A can be a soft nipped. Under that arrangement, hard-nipped rollers at location B could take control of an envelope before it was completely out of the control of rollers at location A. As a result, the size of PCM 1 will not be limited in the manner described above, and PCM 1 can effectively be made up of one set of rollers 10, and be very short in length. However, soft nipped rollers at location A introduce additional variation into the system which can make correction less reliable.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A pitch correcting system for correcting spacing between serially fed documents in an inserter system, the pitch correcting system comprising:

an upstream transport for transporting documents at a nominal velocity in a transport path;

a downstream transport for transporting documents at the nominal velocity in the transport path;

a pitch correcting transport located in between the upstream transport and the downstream transport, the pitch correcting transport receiving documents from the upstream transport and transporting them to the downstream transport;

a sensor arrangement generating pitch signals identifying a measured pitch between a downstream document and a consecutive upstream document arriving at the pitch correcting transport; and a controller receiving the pitch signals from the sensor arrangement, the controller comparing the measured pitch with a nominal pitch and determining a variance of the measured pitch from the nominal pitch, the controller controlling an acceleration of the pitch correcting transport to correct the variance while the upstream document is under the control of the pitch correcting transport, and the controller controlling the pitch correcting transport to return the upstream document to the nominal velocity before transferring the upstream document to the downstream transport;

wherein the pitch correcting transport further comprises a removable pitch correcting module positioned between the upstream transport and the downstream transport.

2. The system of claim 1 wherein the upstream transport further comprises an upstream output location at the most downstream end of the upstream transport, the downstream transport further comprises a downstream input location at the most upstream end of the downstream transport, and the pitch correcting transport further comprises a correction input location at the most upstream end of the pitch correcting transport, and a correction output location at the most downstream end of the pitch correcting transport; and wherein the sensor arrangement further comprises an upstream sensor proximal to the upstream output location and a downstream sensor proximal to the correction output location, and whereby the measured pitch between the downstream document and the consecutive upstream document arriving at the pitch correcting transport is determined from sensing that the downstream document leaving the correction output location and sensing the upstream document arriving at the upstream output location for transferal to the pitch correcting transport.

3. The system of claim 2 wherein the controller is further programmed to control the acceleration of the pitch correcting transport to correct the variance only after a trail edge of the upstream document has exited the upstream output location, and only after a trail edge of the downstream document has exited the correction output location.

4. A pitch correcting system for correcting spacing between serially fed documents in an inserter system, the pitch correcting system comprising:

an upstream transport for transporting documents at a nominal velocity in a transport path;

a downstream transport for transporting documents at the nominal velocity in the transport path;

a pitch correcting transport located in between the upstream transport and the downstream transport, the pitch correcting transport receiving documents from the upstream transport and transporting them to the downstream transport;

a sensor arrangement generating pitch signals identifying a measured pitch between a downstream document and a consecutive upstream document arriving at the pitch correcting transport; and a controller receiving the pitch signals from the sensor arrangement, the controller comparing the measured pitch with a nominal pitch and determining a variance of the measured pitch from the nominal pitch, the controller controlling an acceleration of the pitch correcting transport to correct the variance while the upstream document is under the control of the pitch correcting transport, and the controller controlling the pitch correcting transport to return the upstream document to the nominal velocity before transferring the upstream document to the downstream transport;

wherein the upstream transport further comprises an upstream output location at the most downstream end of the upstream transport, the downstream transport further comprises a downstream input location at the most upstream end of the downstream transport, and the pitch correcting transport further comprises a correction input location at the most upstream end of the pitch correcting transport, and a correction output location at the most downstream end of the pitch correcting transport and wherein the sensor arrangement further comprises an upstream sensor proximal to the upstream output location and a downstream sensor proximal to the correction output location, and whereby the measured pitch between the downstream document and the consecutive upstream document arriving at the pitch correcting transport is determined from sensing that the downstream document leaves the correction output location until sensing that the upstream document arrives at the upstream output location for transferal to the pitch correcting transport;

wherein the controller is further programmed to control the acceleration of the pitch correcting transport to correct the variance only after a trail edge of the upstream document has exited the upstream output location, and only after a trail edge of the downstream document has exited the correction output location; and wherein the controller is further programmed to control the acceleration of the pitch correcting transport to complete correcting the variance before a lead edge of a third document, immediately upstream of the upstream document, reaches the correction input location and before a lead edge of the upstream document has reached the downstream input location.

5. The system of claim 3 wherein the serially fed documents are envelopes ranging in size from 6.5 to 10.375 inches in length, and the pitch correcting transport has a length less than or equal to 8.2 inches from the correcting input location to the correcting output location.

6. The system of claim 5 wherein the pitch correcting transport has a length greater than or equal to 5.3 inches from the correcting input location to the correcting output location.

7. A pitch correcting system for correcting spacing between serially fed documents in an inserter system, the pitch correcting system comprising:

an upstream transport for transporting documents at a nominal velocity in a transport path;

a downstream transport for transporting documents at the nominal velocity in the transport path;

a pitch correcting transport located in between the upstream transport and the downstream transport, the pitch correcting transport receiving documents from the upstream transport and transporting them to the downstream transport;

a sensor arrangement generating pitch signals identifying a measured pitch between a downstream document and a consecutive upstream document arriving at the pitch correcting transport; and a controller receiving the pitch signals from the sensor arrangement, the controller comparing the measured pitch with a nominal pitch and determining a variance of the measured pitch from the nominal pitch, the controller controlling an acceleration of the pitch correcting transport to correct the variance while the upstream document is under the control of the pitch correcting transport, and the controller controlling the pitch correcting transport to return the upstream document to the nominal velocity before transferring the upstream document to the downstream transport;

wherein the serially fed documents include a first document, and the controller is further programmed to recognize the first document and to automatically cause the pitch correcting transport to advance the first document by a predetermined displacement.

8. A pitch correcting system for correcting spacing between serially fed documents in an inserter system, the pitch correcting system comprising:

an upstream transport for transporting documents at a nominal velocity in a transport path;

a downstream transport for transporting documents at the nominal velocity in the transport path;

a pitch correcting transport located in between the upstream transport and the downstream transport, the pitch correcting transport receiving documents from the upstream transport and transporting them to the downstream transport;

a sensor arrangement generating pitch signals identifying a measured pitch between a downstream document and a consecutive upstream document arriving at the pitch correcting transport; and a controller receiving the pitch signals from the sensor arrangement, the controller comparing the measured pitch with a nominal pitch and determining a variance of the measured pitch from the nominal pitch, the controller controlling an acceleration of the pitch correcting transport to correct the variance while the upstream document is under the control of the pitch correcting transport, and the controller controlling the pitch correcting transport to return the upstream document to the nominal velocity before transferring the upstream document to the downstream transport;

wherein the controller, controlling the acceleration of the pitch correcting transport to correct the variance, is further programmed to cause constant positive acceleration and constant negative acceleration over equal time intervals, wherein the positive and negative accelerations are of equal magnitude.

9. The system of claim 8 wherein controller determines the magnitude of the positive and negative accelerations as a function of the variance, and as a function of a distance available for which the pitch correcting transport has exclusive control of the upstream document.

10. The system of claim 9 wherein the upstream transport further comprises an upstream output location at the most downstream end of the upstream transport, the downstream transport further comprises a downstream input location at the most upstream end of the downstream transport, and the pitch correcting transport further comprises a correction input location at the most upstream end of the pitch correcting transport, and a correction output location at the most downstream end of the pitch correcting transport; and wherein the sensor arrangement further comprises an upstream sensor proximal to the upstream output location and a downstream sensor proximal to the correction output location, and whereby the measured pitch between the downstream document and the consecutive upstream document arriving at the pitch correcting transport is determined from sensing that the downstream document leaves the correction output location until sensing that the upstream document arrives at the upstream output location for transferal to the pitch correcting transport.

11. The system of claim 10 wherein the controller is further programmed to control the acceleration of the pitch correcting transport to correct the variance only after a trail edge of the upstream document has exited the upstream output location, and only after a trail edge of the downstream document has exited the correction output location.

12. The system of claim 11 wherein the controller is further programmed to control the acceleration of the pitch correcting transport to complete correcting the variance before a lead edge of a third document, immediately upstream of the upstream document, reaches the correction input location and before a lead edge of the upstream document has reached the downstream input location.

13. A method for correcting pitch between serially fed documents in an inserter system, the pitch correcting method comprising:

transporting documents at a nominal velocity with an upstream transport;

transporting documents at the nominal velocity with a downstream transport;

transporting documents at variable velocities from the upstream transport to the downstream transport via a pitch correcting transport;

sensing a measured pitch between a downstream document and a consecutive upstream document arriving at the pitch correcting transport;

comparing the measured pitch to a nominal pitch to determine a pitch variance;

controlling the variable velocities of the pitch correcting transport while the upstream document is under the control of the pitch correcting transport to correct the pitch variance; and controlling the variable velocities of the pitch correcting transport to return the upstream document to the nominal velocity before transferring the upstream document to the downstream transport;

wherein the step of sensing a measured pitch includes measuring an interval from when the downstream document leaves the pitch correcting transport until the upstream document leaves the upstream transport.

14. The method of claim 13 further including the step of controlling the acceleration of the pitch correcting transport to correct the variance only after a trail edge of the upstream document has exited the upstream transport, and only after a trail edge of the downstream document has exited the pitch correcting transport.

15. The method of claim 14 further including the step of controlling the acceleration of the pitch correcting transport to complete correcting the variance before a lead edge of a third document, immediately upstream of the upstream document, reaches the pitch correcting transport and before a lead edge of the upstream document has reached the downstream transport.

16. A method for correcting pitch between serially fed documents in an inserter system, the pitch correcting method comprising:

transporting documents at a nominal velocity with an upstream transport;

transporting documents at the nominal velocity with a downstream transport;

transporting documents at variable velocities from the upstream transport to the downstream transport via a pitch correcting transport;

sensing a measured pitch between a downstream document and a consecutive upstream document arriving at the pitch correcting transport;

comparing the measured pitch to a nominal pitch to determine a pitch variance;

controlling the variable velocities of the pitch correcting transport while the upstream document is under the control of the pitch correcting transport to correct the pitch variance; and controlling the variable velocities of the pitch correcting transport to return the upstream document to the nominal velocity before transferring the upstream document to the downstream transport;

wherein the serially fed documents include a first document, and further including the step of:

automatically advancing the first document by a predetermined displacement.

17. A method for correcting pitch between serially fed documents in an inserter system, the pitch correcting method comprising:

transporting documents at a nominal velocity with an upstream transport;

transporting documents at the nominal velocity with a downstream transport;

transporting documents at variable velocities from the upstream transport to the downstream transport via a pitch correcting transport;

sensing a measured pitch between a downstream document and a consecutive upstream document arriving at the pitch correcting transport;

comparing the measured pitch to a nominal pitch to determine a pitch variance;

controlling the variable velocities of the pitch correcting transport while the upstream document is under the control of the pitch correcting transport to correct the pitch variance; and controlling the variable velocities of the pitch correcting transport to return the upstream document to the nominal velocity before transferring the upstream document to the downstream transport;

wherein the step of controlling the acceleration of the pitch correcting transport to correct the variance further includes applying constant positive acceleration and constant negative acceleration over equal time intervals, wherein the positive and negative accelerations are of equal magnitude.

18. The method of claim 17 wherein the step of controlling the acceleration of the pitch correcting transport to correct the variance further includes determining the magnitude of the positive and negative accelerations as a function of the variance, and as a function of a distance available for which the pitch correcting transport has exclusive control of the upstream document.

19. The method of claim 18 wherein the step of sensing a measured pitch includes measuring an interval from when the downstream document leaves the pitch correcting transport until the upstream document leaves the upstream transport.

20. The method of claim 19 further including the steps of controlling the acceleration of the pitch correcting transport to correct the variance only after a trail edge of the upstream document has exited the upstream transport, and only after a trail edge of the downstream document has exited the pitch correcting transport, and controlling the acceleration of the pitch correcting transport to complete correcting the variance before a lead edge of a second subsequent upstream document reaches the pitch correcting transport and before a lead edge of the upstream document has reached the downstream transport.

* * * * *